US005603891A

United States Patent [19]

Brill

[11] Patent Number: 5,603,891

[45] Date of Patent: Feb. 18, 1997

[54] HEAT RESISTANT HOT FORMABLE AUSTENITIC NICKEL ALLOY

[75] Inventor: Ulrich Brill, Dinslaken, Germany

[73] Assignee: Krupp VDM GmbH, Werdohl, Germany

[21] Appl. No.: 477,862

[22] Filed: Jun. 7, 1995

Related U.S. Application Data

[63] Continuation of Ser. No. 935,531, Aug. 25, 1992, abandoned.

[30] Foreign Application Priority Data

Nov. 9, 1991 [DE] Germany ..... 41 30 139.0

[51] Int. Cl.[6] ..... C22C 19/07; C22C 30/00

[52] U.S. Cl. ..... 420/443; 420/584.1

[58] Field of Search ..... 420/443, 446, 420/447, 448, 449, 450, 584.1; 148/404, 410, 419, 428, 442

[56] References Cited

U.S. PATENT DOCUMENTS

| | | | |
|---|---|---|---|
| 3,758,294 | 9/1973 | Bellot et al. | 420/584.1 |
| 3,926,620 | 12/1975 | Kowaka et al. | 420/586 |
| 4,099,966 | 7/1978 | Chivinsky et al. | 148/442 |
| 4,388,125 | 6/1983 | Benn | 420/584.1 |
| 4,671,929 | 6/1987 | Kajimura et al. | 420/584.1 |
| 4,840,768 | 6/1989 | Domian et al. | 420/586 |
| 5,077,006 | 12/1991 | Culling | 420/584.1 |
| 5,302,097 | 4/1994 | Brill | 420/584.1 |

FOREIGN PATENT DOCUMENTS

| | | | |
|---|---|---|---|
| 03811121 | 8/1990 | European Pat. Off. . | |
| 0391381 | 10/1990 | European Pat. Off. . | |
| 56-163244 | 12/1981 | Japan | 420/584.1 |
| 703483 | 2/1954 | United Kingdom . | |
| 734210 | 7/1955 | United Kingdom . | |

*Primary Examiner*—David A. Simmons
*Assistant Examiner*—Margery S. Phipps
*Attorney, Agent, or Firm*—Meltzer, Lippe, Goldstein et al.

[57] ABSTRACT

The invention relates to a heat resistant hot formable austenitic nickel alloy consisting of (in % by weight)

| | |
|---|---|
| carbon | 0.05 to 0.15 |
| silicon | 2.5 to 3.0 |
| manganese | 0.2 to 0.5 |
| phosphorus | max 0.015 |
| sulphur | max 0.005 |
| chromium | 25 to 30 |
| iron | 20 to 27 |
| aluminium | 0.05 to 0.15 |
| calcium | 0.001 to 0.005 |
| rare earths | 0.05 to 0.15 |
| nitrogen | 0.05 to 0.20 |

residue nickel and the usual impurities due to melting.

6 Claims, 3 Drawing Sheets

HEAT RESISTANT HOT FORMABLE AUSTENITIC NICKEL ALLOY

This is a continuation of application Ser. No. 07/935,531, filed Aug. 25, 1992, now abandoned.

The invention relates to a heat resistant hot formable austenitic nickel alloy and its use as a material for the production of heat resistant, corrosion resistant particles.

BACKGROUND OF THE INVENTION

Hitherto the nickel alloy having Material No. 2.4856 in the Iron and Steel List of the Verein deutscher Eisenh üttenleute has been used for articles which must be resistant to carbonization, sulphidization and oxidation in the temperature range of 500 ° to 1000° C., more particularly with cyclic stressing. The alloy consists of (in % by weight) max. 0.10% carbon, max. 0.5% silicon, max. 0 5% manganese, 20–23% chromium, 8–10% molybdenum, 3.15–4.15% niobium, max. 0 4% titanium, max 0.4% aluminium, residue nickel. However, in heavily carbonizing conditions this standard alloy shows heavy carbonization at temperatures above 900° C., taking the form of a distant increase in weight due to heavy carbide precipitations and carbon absorption. As a result the mechanical properties, more particularly long-term strength, are also unfavourably affected thereby. The standard alloy shows clear damage due to sulphur absorption even in oxidizing/sulphidizing conditions such as, for example, a gaseous atmosphere of nitrogen and 10% $SO_2$ at 750° C.

The austenitic steel disclosed in EP 0 135 321 containing (details in % by weight) max. 0.03% carbon, 20–35% chromium, 17–50% nobium and 2–6% silicon, is as a result of its high silicon content resistant to corrosion in heavily oxidizing mineral acids, such as nitric acid, but it is unsuitable for use at temperatures above 500° C. in carbonizing, sulphidizing and oxidizing conditions.

BRIEF STATEMENT OF THE INVENTION

It is an object of the invention to provide a nickel-based alloy which can be used without limitation in the temperature range of 500° to 1000° C. in carbonizing, sulphidizing and oxidizing conditions, more particularly with cyclic stressing.

This problem is solved by an austenitic nickel alloy consisting of (details in % by weight)

| | |
|---|---|
| carbon | 0.05 to 0.15 |
| silicon | 2.5 to 3.0 |
| manganese | 0.2 to 0.5 |
| phosphorus | max 0.015 |
| sulphur | max 0.005 |
| chromium | 25 to 30 |
| iron | 20 to 27 |
| aluminium | 0.05 to 0.15 |
| calcium | 0.001 to 0.005 |
| rare earths | 0.05 to 0.15 |
| nitrogen | 0.05 to 0.20 |

residue nickel and the usual impurities due to melting.

The alloy according to the invention can be advantageously used as a material for the production of articles which must be resistant to carbonization, sulphidization and oxidation at temperatures in the range of 500 ° to 1000° C., more particularly with cyclic stressing.

It is preferably used as a material for the production of installations for thermal garbage disposal or for coal gasification and components of such installations. More particularly in the case of garbage disposal in incineration installations, the furnace components are heavily cyclically stressed by changing temperatures during heating and cooling and also by fluctuations in the composition of the waste gas.

The alloy is also outstandingly suitable as a material for heating conductors in which the first requirement is satisfactory resistance to oxidation at temperatures up to 1000° C. Since in furnaces such as firing kilns the heating gases exert a heavily carbonizing effect on incorporated furnace components and moreover sulphur contaminations may occur, in dependence on the fuel used, the alloy according to the invention can be used without limitation as a material for the production of thermally stressed incorporated furnace components, such as supporting frameworks for firing kilns, conveyor rails and conveyor belts.

The advantageous properties of the nickel alloy according to the invention are achieved by:

- the fixing of the carbon content at 0.05–0.15% by weight in combination with nitrogen contents of 0.05–0.20% by weight is the reason for the satisfactory heat resistance and creep strength of the alloy according to the invention.
- Silicon contents of 2.5–3.0% by weight in combination with 25–30% by weight chromium have a favourable effect on resistance to sulphidization. Moreover, these silicon contents produce a formability by rolling and forging which is still adequate. Nor do the selected silicon contents adversely affect the weldability of the material.
- The high nickel content, 45–50% by weight on an average, in combination with 2.5–3.0% by weight silicon, is the reason for the resistance in heavily carbonizing media.
- The chromium contents of 25–30% by weight in combination with a calcium content of 0.001–0.005% by weight, and also a total content of 0.05–0.15% rare earths, such as cerium, lanthanum and the other elements of the group of actinides and lanthanoids, produce excellent resistance to oxidation, more particularly in cyclic/thermal operating conditions, due to the build-up of a thin, satisfactorily adhering and protective oxide layer.
- The iron contents of 20–27% by weight enable cheap ferro-nickel batch materials to be used in the melting of the alloy.

DESCRIPTION OF PREFERRED EMBODIMENT

The nickel alloy according to the invention (alloy A) will now be explained in greater detail in comparison with the prior art alloy 2.4856 (alloy B). Table 1 shows actual content analyses of the compared alloys A and B (details in % by weight)

TABLE 1

| | Alloy A | Alloy B |
|---|---|---|
| Carbon | 0.086 | 0.021 |
| Silicon | 2.76 | 0.15 |
| Manganese | 0.29 | 0.17 |
| Phosphorus | 0.011 | 0.007 |
| Sulphur | 0.003 | 0.004 |

TABLE 1-continued

| | Alloy A | Alloy B |
|---|---|---|
| Chromium | 27.0 | 22.20 |
| Iron | 23.3 | 2.71 |
| Aluminium | 0.12 | 0.13 |
| Calcium | 0.003 | 0.003 |
| Rare earths | 0.058 | — |
| Nitrogen | 0.08 | 0.02 |
| Nickel | 46.25 | 63 |
| Niobium | — | 2.4 |
| Molybdenum | — | 9.1 |

The specific change in weight in $g/m^2$ is plotted over the time in hours. The test medium was a gaseous mixture of $CH_4/H_2$ with a carbon activity of $a_c$ =0.8. The test temperature was 1000° C.

The test was performed cyclically—i.e., with a cycle lasting 24 hours the holding time at test temperature was 16 hours with a total of 8 hours heating and cooling.

Alloy A according to the invention showed a clearly lower increase in weight than the comparison alloy B.

Figure 1:
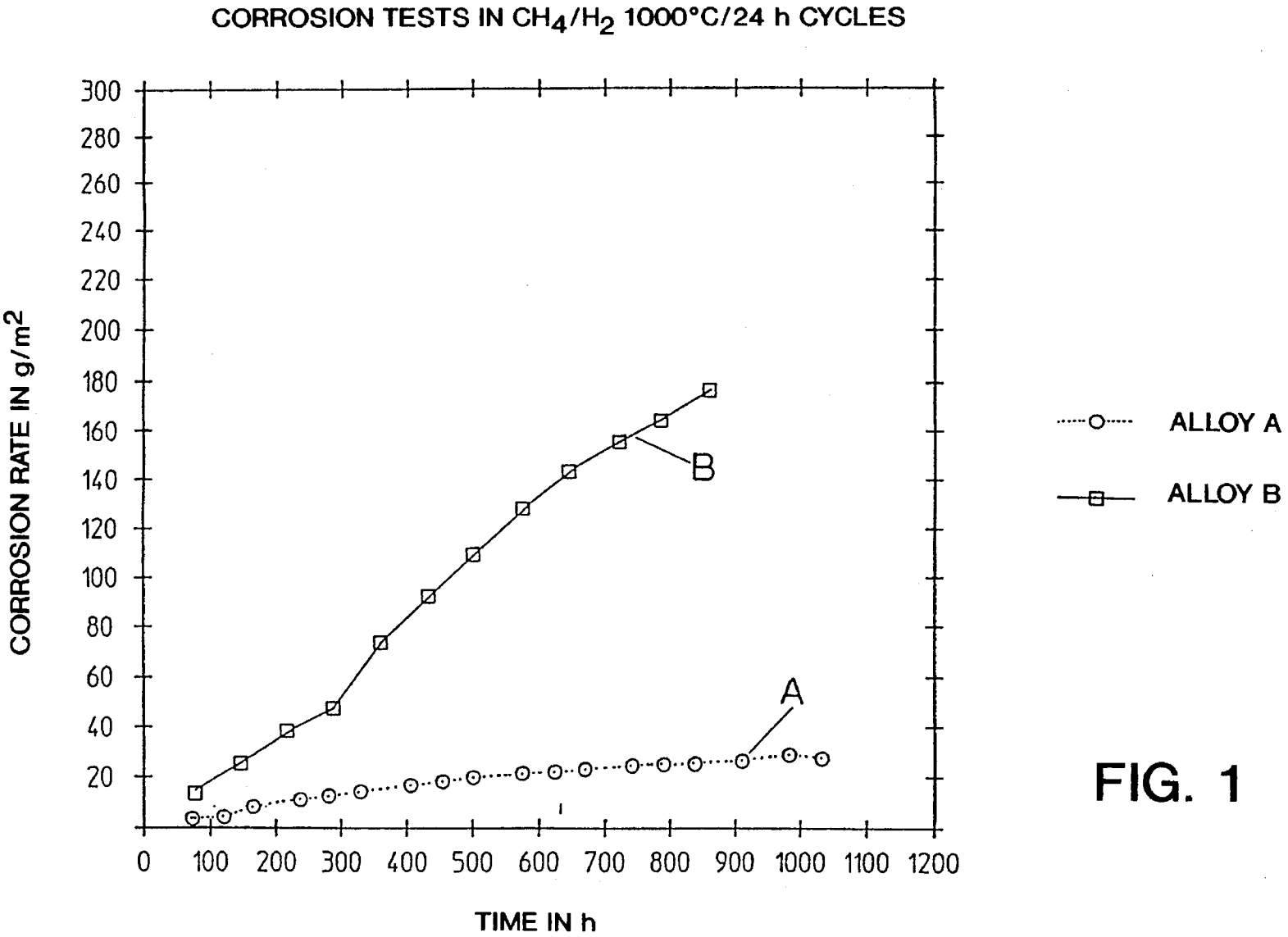
FIG 1 shows the carbonization behaviour of alloy A in comparison with alloy B.
Figure 2:
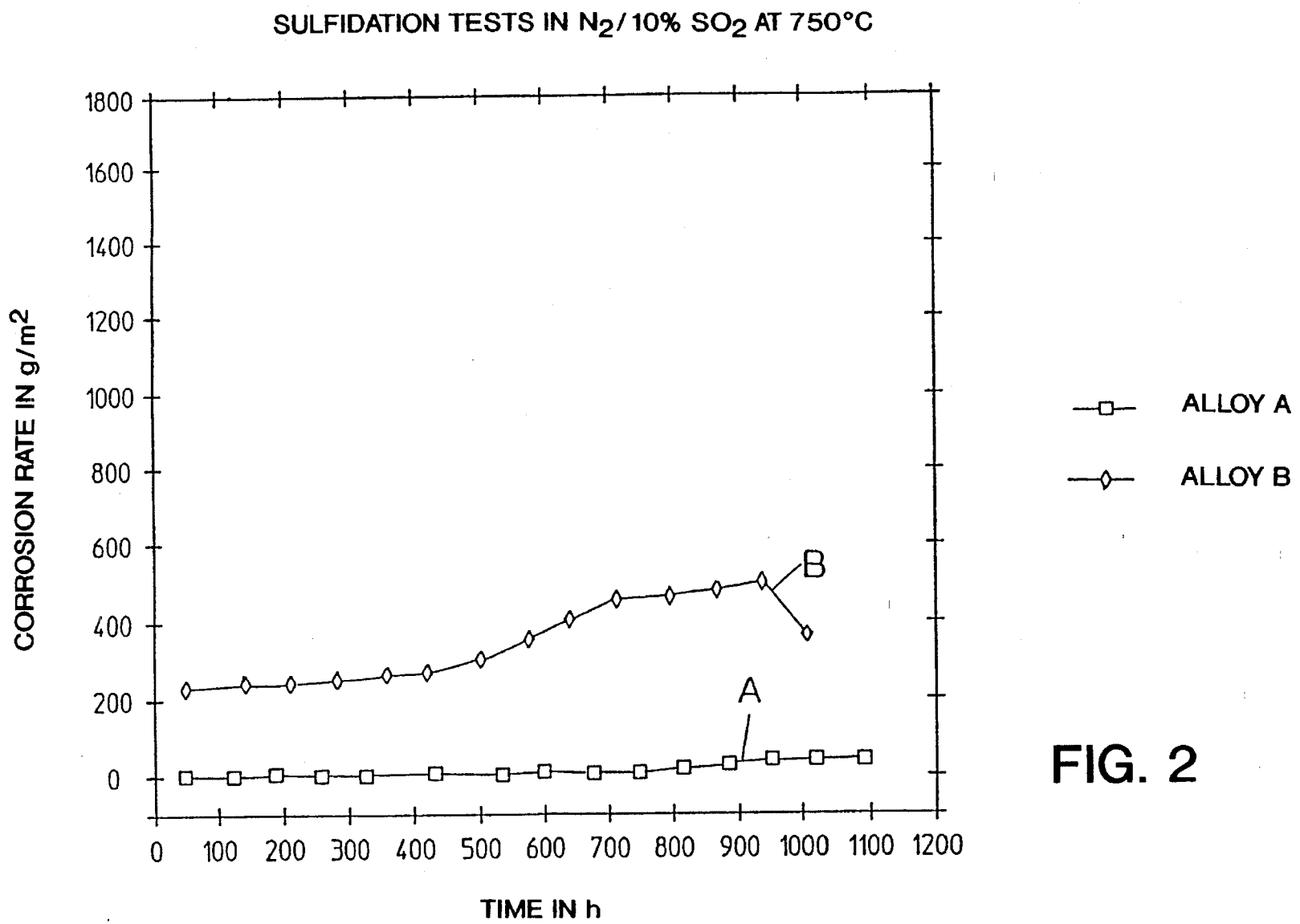

FIG. 2 The presentation and test method corresponded to those shown in FIG. 1, except that in this case the test medium was nitrogen +10% $SO_2$ tested at 750° C. for resistance to sulphidization. This test also showed alloy A to be superior to alloy B as regards change in weight.

Figure 3:
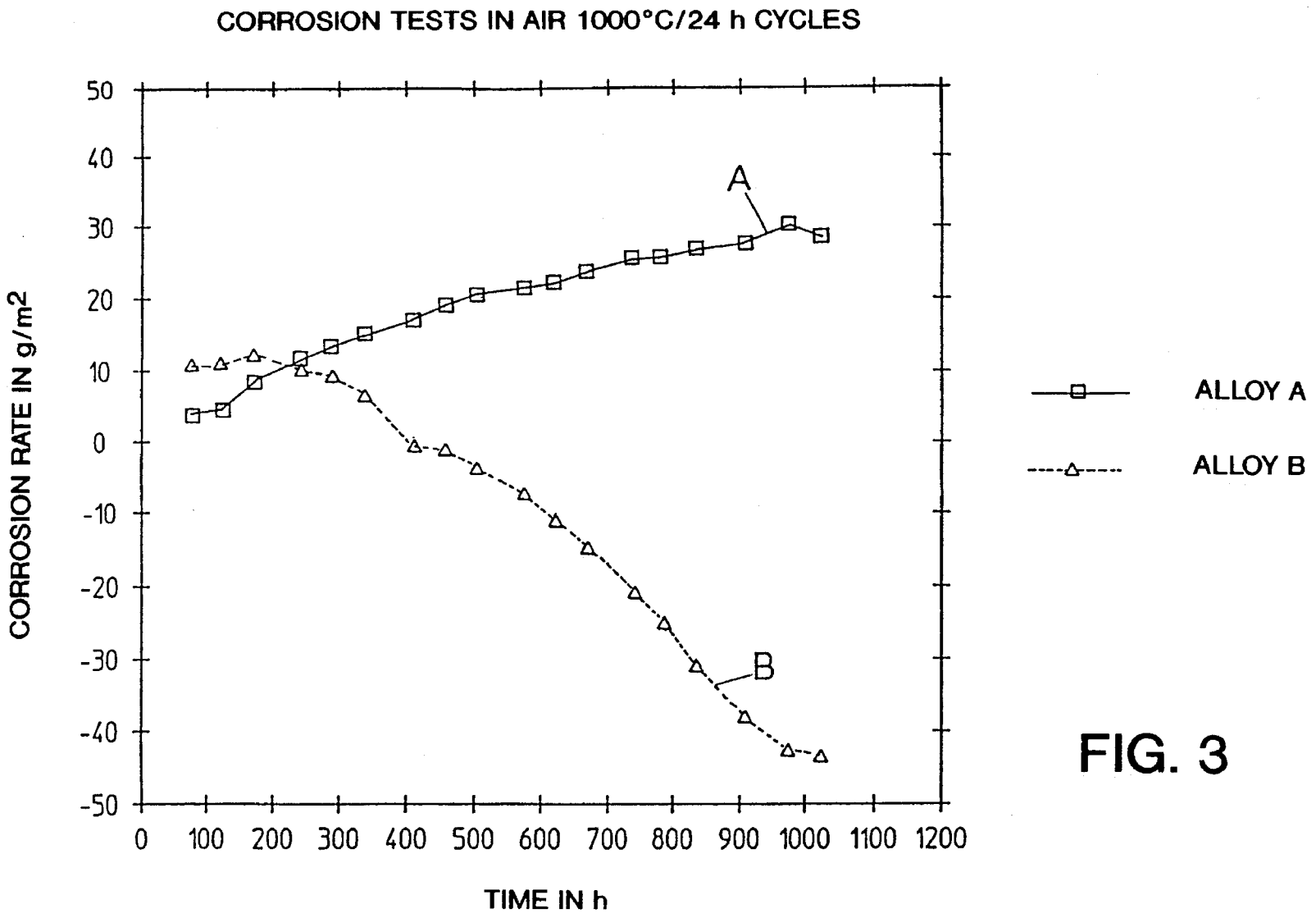

FIG. 3 illustrates the cyclic oxidation behaviour of the comparison materials A and B in air at 1000° C. The test material and presentation of the results correspond to those in FIG. 1. The clearly improved oxidation behaviour of the alloy A according to the invention with cyclic temperature stressing can be seen from the increase in weight (change in weight = (+)) still measured even after more than 1000 hours of testing, something which is a proof of the presence of a satisfactorily adhering oxide layer.

The losses in weight of the comparison alloy B (change in weight = (−)) mean that in these oxidizing conditions this alloy shows heavy scale peeling—i.e., it fails when used in practice.

What is claimed is:

1. A heat resistant hat formable austenitic nickel alloy consisting of

| | |
|---|---|
| carbon | 0.05 to 0.15 |
| silicon | 2.5 to 3.0 |
| manganese | 0.2 to 0.5 |
| phosphorus | max 0.015 |
| sulphur | max 0.005 |
| chromium | 25 to 30 |
| iron | 20 to 27 |
| aluminum | 0.05 to 0.15 |
| calcium | 0.001 to 0.005 |
| rare earths | 0.05 to 0.15 |
| nitrogen | 0.05 to 0.20 |

balance nickel and residual impurities.

2. An article made from the alloy of claim 1 which is resistant to carbonization, sulphidization and oxidation at temperatures in the range of 500 ° to 1000° C., even under conditions of cyclic stressing.

3. An installation for thermal garbage disposal made from the austenitic nickel alloy of claim 1.

4. An installation for coal gasification made from the austenitic nickel alloy of claim 1.

5. A heating conductor made from the austenitic nickel alloy of claim 1.

6. A furnace including components made from the austenitic nickel alloy of claim 1.

* * * * *